US005395487A

United States Patent [19]

Sharma

[11] Patent Number: 5,395,487

[45] Date of Patent: Mar. 7, 1995

[54] ELECTROLYTIC EXTRACTION OF MAGNESIUM FROM A MAGNESIUM-CONTAINING ALUMINUM ALLOY

[75] Inventor: Ram A. Sharma, Troy, Mich.

[73] Assignee: General Motors Corporation, Detroit, Mich.

[21] Appl. No.: 192,513

[22] Filed: Feb. 7, 1994

[51] Int. Cl.[6] ..... C25C 3/04; C25C 1/00

[52] U.S. Cl. ..... 204/61; 204/70

[58] Field of Search ..... 204/70, 67

[56] References Cited

U.S. PATENT DOCUMENTS

| | | | |
|---|---|---|---|
| 1,910,017 | 5/1933 | Hulin | 204/70 X |
| 3,341,437 | 9/1967 | Wood | 204/61 |
| 3,729,397 | 4/1973 | Goldsmith et al. | 204/70 X |
| 4,192,724 | 3/1980 | Minami et al. | 204/70 X |
| 5,015,343 | 5/1991 | La Camera et al. | 204/61 X |
| 5,279,716 | 1/1994 | Sharma | 204/70 |
| 5,290,337 | 3/1994 | Sharma | 75/393 |

*Primary Examiner*—Donald R. Valentine
*Attorney, Agent, or Firm*—George A. Grove

[57] ABSTRACT

An electrolytic process is provided for extracting magnesium metal from magnesium-containing aluminum alloys, in which magnesium oxide which is inherently and undesirably formed during electrolytic demagging of an aluminum alloy is destroyed in situ, and a regenerating process is performed within the same electrolytic demagging cell. The magnesium oxide is reacted with a rare earth chloride within the electrolyte to form magnesium chloride and rare earth oxychloride, which are then electrochemically decomposed to form rare earth chloride and molten magnesium which can be recovered from the demagging cell. Intermittent regeneration of the electrolyte substantially re-establishes the original electrolyte formulation. Thereafter, the demagging cell again reverts to the demagging process by which the aluminum alloy is electrolytically demagged to form molten magnesium metal.

15 Claims, 1 Drawing Sheet

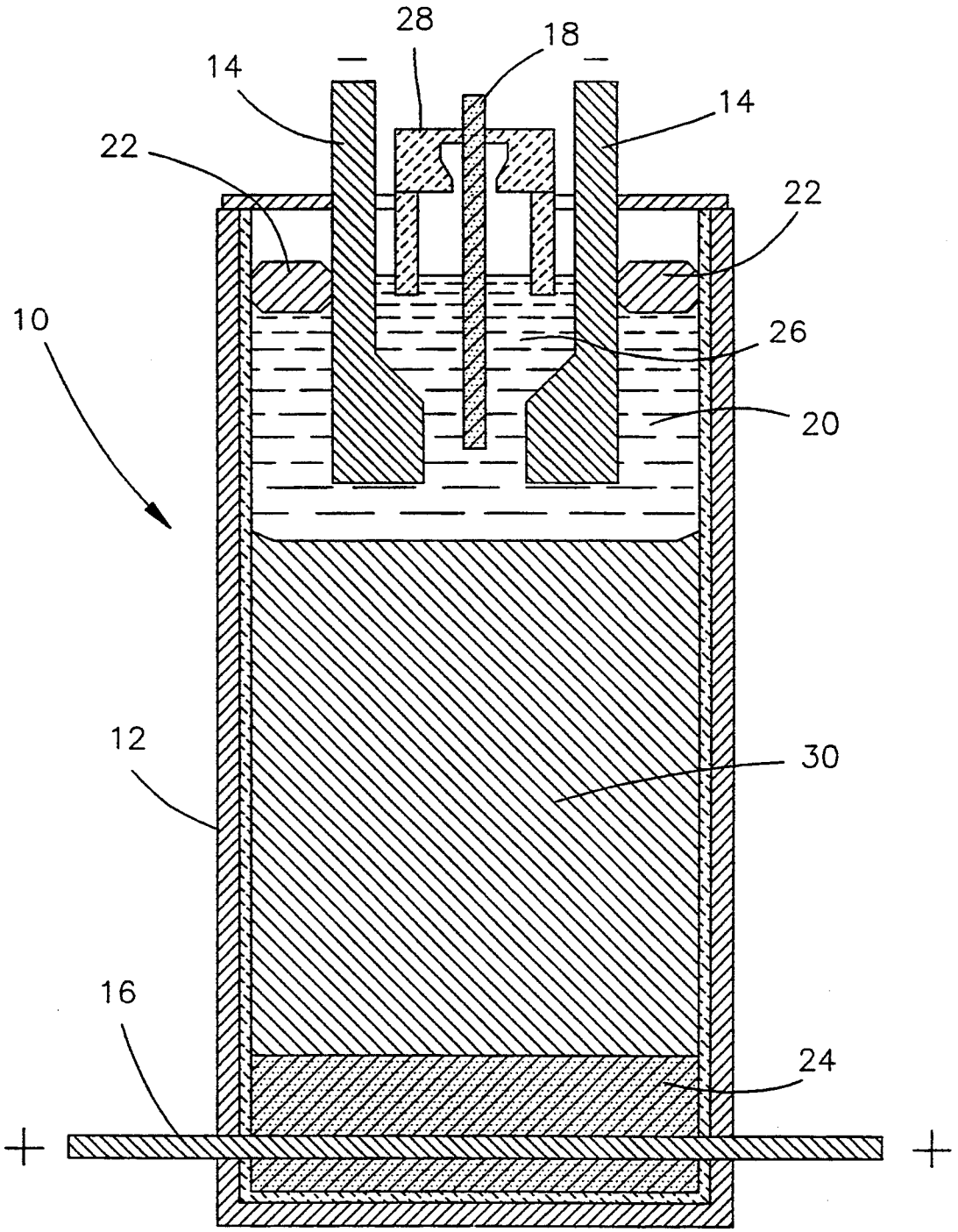
28
18
14
14
22
22
10
26
20
12
30
16
24
+
+

ELECTROLYTIC EXTRACTION OF MAGNESIUM FROM A MAGNESIUM-CONTAINING ALUMINUM ALLOY

The present invention generally relates to the electrolytic extraction of magnesium metal from a magnesium-containing aluminum alloy by demagging of an anode formed from such an aluminum alloy through an electrochemical reaction in an electrolytic bath. More particularly, this invention relates to an improved electrolytic demagging process of this type in which the process is carried out in a molten salt electrolyte to which a rare earth chloride is added, wherein the rare earth chloride serves to dissolve the solid magnesium oxide that undesirably forms in the electrolyte, so as to promote the coalescing of molten magnesium droplets during the demagging process.

BACKGROUND OF THE INVENTION

It is known in the art to electrolytically extract magnesium metal from an aluminum-magnesium scrap alloy through a process referred to as electrolytic demagging. This process is performed in an electrolytic demagging cell containing a molten salt bath, typically composed of magnesium chloride ($MgCl_2$) and various other salts, such as calcium chloride ($CaCl_2$), potassium chloride (KCl) and sodium chloride (NaCl). Conventionally, the aluminum-magnesium scrap alloy forms the anode for the electrolytic process, while the cathode is formed of a mild steel structure. The magnesium within the aluminum-magnesium anode is electrolytically oxidized to produce magnesium cations which dissolve in the electrolyte at temperatures between about 700° C. and about 750° C. The magnesium cations are then reduced at the cathode such that droplets of molten magnesium metal (Mg) are deposited on the cathode. Accordingly, the net reaction is the electrolytic transport of magnesium from its aluminum-magnesium alloy at the anode to its pure state at the cathode.

In order to recover the molten magnesium metal, the electrolyte is formulated to have a density which is greater than that of magnesium, such that the molten magnesium will float to the top of the electrolyte and form a layer which can be recovered mechanically. However, a significant problem with the process described above is that the droplets of molten magnesium which are deposited on the cathode do not readily coalesce to the extent necessary to form a mass of molten metal which will float to the surface of the electrolyte. The droplets do not coalesce because of solid magnesium oxide (MgO) present in the electrolyte, which forms a film on the surfaces of the molten metal droplets. Magnesium oxide, which is practically insoluble in the electrolyte, results principally from the reaction of magnesium chloride with water in the electrolyte, as well as any other source of oxygen, such as the atmosphere or the aluminum-magnesium scrap metal. Because the magnesium droplets do not coalesce, they tend to spread throughout the electrolyte, causing short-circuiting between the anode and cathode, which may ultimately lead to cell failure.

Thus, it would be desirable to provide an electrolytic demagging process by which the magnesium oxide film on the magnesium droplets is destroyed and/or magnesium oxide present within the electrolyte is dissolved and electrolyzed, so as to enable the magnesium droplets to coalesce and float as a continuous molten layer on the top of the electrolyte. In particular, it would be desirable if such a process was accomplished in situ by eliminating the magnesium oxide in the electrolyte, in which the electrolyte is regenerated as necessary, in order to provide an economical electrolytic demagging process suitable for use in the industry.

SUMMARY OF THE INVENTION

It is an object of this invention to provide an electrolytic demagging process for producing magnesium metal, wherein the process is both economical and practical in terms of efficiency and process costs.

It is a further object of this invention that such a process promote coalescence of molten magnesium droplets during the electrolytic demagging of a magnesium-containing aluminum alloy, so as to enable the magnesium droplets to more readily form a continuous molten layer on the top of the electrolyte bath.

It is another object of this invention that such a process eliminate and/or destroy a magnesium oxide film on the surface of the magnesium droplets which may tend to form within the electrolyte bath.

It is still another object of this invention that such a process involve destroying the magnesium oxide in situ, so as to regenerate the electrolyte.

It is yet another object of this invention that such a process utilize an electrolytic demagging cell which enables the electrolyte to be regenerated in situ.

In accordance with a preferred embodiment of this invention, these and other objects and advantages are accomplished as follows.

According to the present invention, there is provided an electrolytic process for extracting magnesium metal from magnesium-containing aluminum alloys, in which the magnesium oxide formed during electrolytic demagging of an aluminum alloy is spontaneously dissolved during the demagging process and then the electrolyte is regenerated during a subsequent electrolytic regenerating process, wherein both the demagging and regenerating processes are carried out in the same electrolytic demagging cell. The magnesium oxide is reacted with a constituent within the electrolyte to form magnesium chloride and another compound. Once the magnesium oxide has been substantially eliminated during the regenerating process, the demagging cell again reverts to the demagging process for further use.

The process of this invention involves the use of a rare earth chloride as a constituent of a molten salt electrolyte. A suitable magnesium-containing aluminum alloy is electrolytically demagged through the electrolyte by oxidizing the magnesium from the aluminum alloy so as to form magnesium cations which are subsequently reduced at a cathode to produce molten magnesium droplets. The demagging process may continue until unacceptable levels of magnesium oxide are accumulated, at which time it is discontinued. Thereafter, the electrolyte is electrolytically regenerated by imposing a potential between the cathode and an anode which is suitable to decompose magnesium oxide present in the electrolyte to produce magnesium cations, which are then electrolytically reduced at the cathode to produce molten magnesium metal. In view of the above, it is preferable that the rare earth chloride be introduced into the electrolyte in a quantity sufficient to react with all magnesium oxide during the electrolytic regenerating step.

As an example, using neodymium chloride as the rare earth chloride, the neodymium chloride will react with magnesium oxide within the electrolyte to form magnesium chloride and neodymium oxychloride by the following reaction:

$$NdCl_3 + MgO\ NdOCl + MgCl_2 \quad (1)$$

Magnesium chloride and neodymium oxychloride both should be soluble in the electrolyte according to the $MgCl_2$-NdOCl phase diagram. The above reaction tends to be spontaneous in that it has a negative free energy change at the relevant operating temperatures. As result of this reaction, magnesium oxide which forms during the electrolytic demagging of the aluminum alloy will continuously react to form magnesium chloride and neodymium oxychloride, so long as neodymium chloride is available within the electrolyte. Therefore, if enough rare earth chloride is present in the electrolyte, magnesium oxide is continuously eliminated as a solid from the electrolyte and prevented from forming the undesirable film which, as noted previously, inhibits coalescence of the molten magnesium droplets at the cathode. During the regenerating step, the product of the magnesium oxide-rare earth chloride reaction which is composed of magnesium chloride and rare earth oxychloride is electrochemically decomposed by utilizing an auxiliary carbon or graphite anode and the demagging cathode. During the regenerating step, magnesium droplets form on the cathode and carbon monoxide at the anode, thus eliminating magnesium oxide from the electrolyte and regenerating the rare earth chloride.

The two step demagging-regenerating process of this invention is more economical and practical than methods previously known in that magnesium metal is more efficiently recovered from the electrolytic cell. In that any and all magnesium oxide formed in the electrolyte will be reacted with the rare earth chloride, the process of this invention can be carried out so as to substantially prevent the formation of a film which will interfere with the ability of the molten magnesium droplets to coalesce and float to the surface of the electrolyte. As a result, the process of this invention greatly facilitates the recovery of magnesium metal using an electrolytic demagging process. Finally, the process is able to destroy the magnesium oxide in situ, so as to permit regeneration of the electrolyte as needed within the same electrolytic cell. As such, there is no requirement for the costly and time-consuming processes of preparing a new electrolyte due to contamination by magnesium oxide. In order to carry out the demagging-regenerating operation in the manner described above, the process of this invention also provides an electrolytic demagging cell which utilizes separate anodes for the demagging and regenerating processes.

Other objects and advantages of this invention will be better appreciated from the following detailed description.

BRIEF DESCRIPTION OF THE DRAWING

The above and other advantages of this invention will become more apparent from the following description taken in conjunction with the accompanying drawing, which shows an electrolytic demagging cell that is configured to perform the demagging and regenerating processes in accordance with this invention.

DETAILED DESCRIPTION OF THE INVENTION

A process is provided for the electrolytic extraction of magnesium metal from a magnesium-containing aluminum alloy. In particular, the process of this invention involves a demagging operation in which magnesium metal is electrolytically extracted from a magnesium-containing aluminum alloy, and a regenerating operation in which magnesium oxide formed during the electrolytic demagging of the aluminum alloy is substantially removed from the electrolyte. With such a regenerating step, magnesium metal ordinarily lost as sludge is reclaimed and removed from the electrolyte as molten magnesium metal. The process of this invention also provides for the ability to continuously dissolve magnesium oxide during the demagging operation. The absence of solid magnesium oxide within the electrolyte bath allows molten magnesium droplets which are formed during the demagging operation to coalesce and thereby form a continuous molten layer on the top of the electrolyte bath. As a distinct advantage of this invention, the demagging and regenerating operations are performed within the same electrolytic demagging cell.

In accordance with this invention, regeneration of the electrolyte is made possible by the inclusion of a rare earth chloride in the electrolyte bath which, at conventional demagging temperatures, tends to spontaneously react with the magnesium oxide produced during the demagging operation to form magnesium chloride and a rare earth oxychloride. The product is then electrochemically decomposed during the regenerating operation to form molten magnesium metal, which can be recovered utilizing known mechanical methods.

Other than the rare earth chloride, the remaining composition of the electrolyte bath is dictated by the need for chemical stability in the presence of the aluminum alloy and magnesium metal, as well as availability and cost of the constituents. Preferably, the electrolyte bath, which is completely molten, should have a density which is lower than that of aluminum and higher than that of magnesium, have a melting temperature which is lower than those of aluminum and magnesium, and exhibit a high ionic conductivity. Based on these requirements, as well as the standard decomposition potentials for known electrolyte salts, an electrolyte consisting of magnesium chloride ($MgCl_2$) with other components such as calcium chloride ($CaCl_2$), lithium chloride (LiCl), sodium chloride (NaCl), potassium chloride (KCl) and magnesium fluoride ($MgF_2$) is suitable. As the rare earth chloride, neodymium chloride ($NdCl_3$) is used as an example. Although further references to the use of $NdCl_3$ as the rare earth chloride will be made below, all rare earth chlorides are essentially similar to neodymium chloride, such that any other rare earth chloride can be used in place of neodymium chloride if desired or necessary.

A suitable density and melting point for the electrolyte can be achieved by appropriately selecting the above salts in appropriate quantities. A preferred operating temperature range for the demagging-regenerating process of this invention is about 700° C. to about 850° C. The amount of the rare earth chloride introduced into the bath must be sufficient to react with all of the magnesium oxide formed in the electrolyte bath. In a preferred embodiment, for example, about 10 weight percent neodymium chloride may be used in a conventional electrolyte known in the prior art. This amount can be adjusted based upon chemical analysis of the electrolyte bath, or by trial and error, and foreseeably may vary from a very small amount to a very large amount.

An electrolytic demagging cell 10 configured for use in the process of this invention is shown in the Figure. The demagging cell 10 is similar to that of an electrolytic magnesium production cell in that it deposits molten magnesium metal from a similar magnesium chloride-containing electrolyte at a similar operating temperature. Accordingly, the demagging cell 10 may include a steel container 12 which is lined with fused alumina, and a mild steel cathode 14, each of which may be of the type used in conventional magnesium production cells. As is generally conventional, a magnesium-containing aluminum alloy 30 serves as the anode for the demagging cell 10, in cooperation with an anode terminal 16 which is embedded within a quantity of carbon or carbon-containing material 24 at the bottom of the demagging cell 10. The electrolyte 20 contacts both the aluminum alloy 30 and the cathode 14 in order to allow the desired electrolytic demagging reaction to occur. Molten magnesium metal generated by this process is shown floating on the surface of the electrolyte 20 as a continuous molten layer 22.

In contrast to conventional demagging cells, the demagging cell 10 of ibis invention further includes a second anode 18 for use during the regenerating operation. The second a node 18 extends from refractory semi-walls 28 into the electrolyte 20 within a magnesium production chamber 26 defined by the cathode 14. The anode 18 is preferably tubular-shaped and formed from amorphous carbon, such as graphite, and a binder, as is known for the electrolytic production of aluminum. During the regenerating operation, the anode 18 generates carbon monoxide for regenerating neodymium chloride, as will be explained below. In addition it is preferred that argon gas be passed through the anode 18 in order to sweep carbon monoxide bubbles from the anode 18 during the regenerating operation, as well as assist in lifting molten magnesium metal droplets to the surface of the electrolyte bath during the demagging operation.

With reference to the demagging cell 10, the demagging and regenerating operations made possible by this invention will be described below.

The electrolytic demagging of a magnesium-containing aluminum alloy can be carried out at substantially conventional temperatures by applying a suitable electrical potential across the cathode 14 and anode 16 to create a current which passes through the electrolyte 20. The result is the oxidation of the aluminum alloy 30 to produce magnesium cations. The magnesium cations dissolve in the electrolyte 20 and are reduced at the cathode 14 to form droplets of molten magnesium metal. In the absence of magnesium oxide, the molten magnesium droplets coalesce, rising to the surface of the electrolyte 20 due to the electrolyte 20 being formulated to have a higher density than magnesium.

As noted previously, though magnesium oxide may not be present within the molten electrolyte bath 20 as originally formulated, it will tend to form from the reaction of magnesium chloride with water: in the electrolyte, as well as any other source of oxygen, such as the atmosphere or the aluminum alloy 30. It is the presence of solid magnesium oxide, which is practically insoluble in the electrolyte, which forms the detrimental film on the magnesium droplets produced during the demagging operation. According to this invention, the magnesium oxide is destroyed by being reacted with the rare earth chloride (e.g., neodymium chloride ($NdCl_3$)), to form a rare earth oxychloride (e.g., neodymium oxychloride (NdOCl)) and magnesium chloride according to the reaction:

$$NdCl_3 + MgO \rightarrow NdOCl + MgCl_2 \quad (1)$$

The above reaction tends to be spontaneous in that it has a negative free energy change at all temperatures. The equilibrium phase diagram of the magnesium chloride-neodymium oxychloride system indicates about 36 mole percent neodymium oxychloride is soluble in magnesium chloride at about 640° C., indicating that neodymium oxychloride should be soluble in any magnesium chloride-based electrolyte within the preferred operating temperature range. Therefore, neodymium oxychloride should be soluble in any magnesium chloride-based electrolyte at a temperature within the preferred demagging temperature range of about 700° C. to about 850° C.

Demagging continues until, for example, unacceptable levels of magnesium oxide are accumulated within the electrolyte 20, at which time the demagging operation is discontinued by disconnecting the anode 16. Thereafter, the anode 18 is connected to a suitable voltage source to commence the regenerating operation. The regenerating operation is performed to substantially re-establish the original formulation of the electrolyte by converting the magnesium chloride and the neodymium oxychloride to magnesium metal and neodymium chloride according to the reaction:

$$MgCl_2 + C(s) + NdOCl \rightarrow NdCl_3 + Mg(l) + CO(g) \quad (2)$$

The decomposition potential versus temperature for the reaction indicates that it will proceed at any imposed potential near about 1.65 volts at about 1000 K (723° C.). Therefore, an increase in potential at a given current will also indicate that practically all of the neodymium oxychloride has been eliminated.

As with the demagging operation, the magnesium metal produced during the regenerating operation forms on the cathode 14 and, because the electrolyte 20 is held above the melting temperature of magnesium metal, the reduced metal collects as a continuous molten layer 22 which can be removed using conventional devices, such as a ladle.

From the above, it can be seen that a significant advantage of this invention is that an electrolytic demagging process employed to produce magnesium metal can be made substantially more economical by allowing for the in situ destruction of magnesium oxide formed within the electrolyte 20, resulting in the ability to regenerate the electrolyte 20 within the same electrolytic cell 10 in which the demagging process is conducted. Consequently, there is no requirement for the costly and time-consuming processes involved in shutting down the electrolytic cell in order to reformulate the electrolyte. Furthermore, due to the absence of magnesium oxide in the electrolyte 20, the molten magnesium droplets which are formed during the demagging operation are able to coalesce and therefore rise to the surface of the electrolyte 20, promoting the ability to more efficiently recover molten magnesium metal produced by the demagging process. In addition, the process of this invention utilizes a substantially regenerating electrolyte bath, with the rare earth chloride being reformed during the electrolytic regeneration operation.

While my invention has been described in terms of a preferred embodiment, it is apparent that other forms could be adopted by one skilled in the art; for example, by modifying the processing parameters such as the temperatures employed, or by substituting or adding appropriate salts to the electrolyte bath. Accordingly, the scope of my invention is to be limited only by the following claims.

The embodiments of the invention in which an exclusive property or privilege is claimed are defined as follows:

1. A method for extracting magnesium metal from a magnesium-containing aluminum ahoy, the method comprising the steps of:

forming a molten salt electrolyte comprising rare earth metal cations and chloride anions;

electrolytically demagging the magnesium-containing aluminum alloy by oxidizing the magnesium so as to form magnesium cations, and thereafter reducing the magnesium cations at a cathode so as to produce molten magnesium metal; and electrolytically regenerating the molten salt electrolyte by imposing a potential between the cathode and an anode so as to produce magnesium cations which are electrolytically reduced at the cathode to produce molten magnesium metal during which steps solid magnesium oxide forms in said electrolyte;

said magnesium oxide being removed by reaction with the rare earth metal cations and the chloride anions to form magnesium chloride and a rare earth oxychloride which dissolve in the molten salt electrolyte, and are thereafter electrolytically decomposed.

2. A method for producing magnesium metal as recited in claim 1 wherein a rare earth chloride is present in the molten salt electrolyte.

3. A method for producing magnesium metal as recited in claim 1 wherein the rare earth metal ions and chloride ions are present in the molten salt electrolyte in an amount sufficient to react any magnesium oxide in the molten salt electrolyte.

4. A method for producing magnesium metal as recited in claim 1 wherein the rare earth cations are neodymium cations.

5. A method for producing magnesium metal as recited in claim 1 wherein said electrolytically regenerating step utilizes a carbon-based anode and an iron-based cathode.

6. A method for producing magnesium metal as recited in claim 1 wherein said electrolytically demagging step includes utilizing the magnesium-containing aluminum alloy as a demagging anode and the cathode is an iron-based cathode.

7. A method for producing magnesium metal from a magnesium-containing aluminum alloy, the method comprising the steps of:

forming a molten salt electrolyte in which a rare earth chloride and magnesium chloride have been included, such that rare earth metal cations, magnesium cations, and chloride anions are present within the molten salt electrolyte;

electrolytically demagging the magnesium-containing aluminum alloy by imposing a potential between a cathode and the aluminum-magnesium alloy while both are immersed in the molten salt electrolyte, such that magnesium within the magnesium-containing aluminum alloy is oxidized so as to form magnesium cations which are reduced at the cathode to produce molten magnesium metal; and electrolytically regenerating the molten salt electrolyte by imposing a potential between the cathode and an anode so as to produce magnesium cations which are electrolytically reduced at the cathode to produce molten magnesium metal;

wherein magnesium oxide which forms in the molten salt electrolyte is reacted with the rare earth metal cations and the chloride anions to form magnesium chloride and rare earth oxychloride.

8. A method for producing magnesium metal as recited in claim 7 wherein the rare earth cations are neodymium cations.

9. A method for producing magnesium metal as recited in claim 7 wherein said electrolytically regenerating step utilizes a carbon-based anode and an iron-based cathode.

10. A method for producing magnesium metal as recited in claim 7 wherein said electrolytically demagging step includes utilizing the magnesium-containing aluminum alloy as a demagging anode and the cathode is an iron-based cathode.

11. A method for producing magnesium metal from a magnesium-containing aluminum alloy, the method comprising the steps of:

forming a molten salt electrolyte for the selective electrolytic oxidation of said magnesium in said alloy, said electrolyte comprising rare earth metal cations, magnesium cations, anti chloride anions;

electrolytically demagging the magnesium-containing aluminum alloy by imposing a potential between an iron-based cathode and the aluminum-magnesium alloy while both are immersed in the molten salt electrolyte, such that the magnesium is oxidized so as to form magnesium cations which are reduced at the cathode to produce molten magnesium metal, solid magnesium oxide forming in said electrolyte during said electrolysis and concomitantly reacting with rare earth metal cations and chloride anions to form rare earth oxychloride and magnesium anions;

discontinuing said demagging step; and electrolytically regenerating the molten salt electrolyte by imposing a potential between the iron-based cathode and a carbon-based anode so as to electrolytically reduce said rare earth oxychloride and said magnesium anions at the iron-based cathode to produce molten magnesium metal, and so as to produce carbon monoxide gas at the carbon-based anode; and wherein said rare earth chloride is regenerated from the rare earth oxychloride during the electrolytic regenerating step.

12. A method for producing magnesium metal as recited in claim 11 wherein the rare earth cations are neodymium cations.

13. A method for producing magnesium metal as recited in claim 11 wherein said electrolytic regenerating step is conducted at a temperature of about 700° C. to about 850° C.

14. A method for producing magnesium metal as recited in claim 11 wherein the carbon-based anode comprises a graphite tube.

15. A method for producing magnesium metal as recited in claim 14 further comprising the step of passing argon gas through the graphite tube so as to scavenge carbon monoxide bubbles during said electrolytic regenerating step and transport molten magnesium metal during said electrolytic demagging step.

* * * * *